US005803031A

United States Patent [19]

Moriya

[11] Patent Number: 5,803,031

[45] Date of Patent: Sep. 8, 1998

[54] HYDRAULIC ACTUATOR IN AN INTERNAL COMBUSTION ENGINE

[75] Inventor: Yoshihito Moriya, Nagoya, Japan

[73] Assignee: Toyota Jidosha Kabushiki Kaisha, Toyota, Japan

[21] Appl. No.: 886,724

[22] Filed: Jul. 1, 1997

[30] Foreign Application Priority Data

Jul. 3, 1996 [JP] Japan ..... 8-173514

[51] Int. Cl.[6] ..... F01L 1/344; F02D 13/02

[52] U.S. Cl. ..... 123/90.17; 123/90.31; 123/90.34; 92/111; 92/112; 92/33

[58] Field of Search ..... 123/90.12, 90.15, 123/90.17, 90.31, 90.33, 90.34; 92/111, 112, 33

[56] References Cited

U.S. PATENT DOCUMENTS

| | | | |
|---|---|---|---|
| 5,170,756 | 12/1992 | Szodfridt | 123/90.17 |
| 5,540,197 | 7/1996 | Schmidt et al. | 123/90.17 |
| 5,638,782 | 6/1997 | Eguchi et al. | 123/90.17 |
| 5,669,343 | 9/1997 | Adachi | 123/90.17 |

FOREIGN PATENT DOCUMENTS

| | | |
|---|---|---|
| 19502496 | 8/1996 | Germany . |
| 19525836 | 8/1996 | Germany . |
| 6330712A | 11/1994 | Japan . |
| WO9324736 | 12/1993 | WIPO . |

*Primary Examiner*—Weilun Lo
*Attorney, Agent, or Firm*—Kenyon & Kenyon

[57] ABSTRACT

A hydraulic actuator including a piston connected to a camshaft. First and second passages extend through the camshaft. The piston is actuated in accordance with differences in pressure applied to the piston through the passages. A bearing rotatably supports the camshaft. The first and second passages open at the circumferential surface of the camshaft. First and second grooves are defined in the bearing and arranged at different positions with respect to the axial and circumferential directions of the camshaft. The first and second grooves are communicated with the first and second passages such that the grooves form substantially sealed hydraulic passages for carrying hydraulic fluid to or from the passages while the camshaft rotates.

17 Claims, 5 Drawing Sheets

HYDRAULIC ACTUATOR IN AN INTERNAL COMBUSTION ENGINE

BACKGROUND OF THE INVENTION

1. Field of the Invention

The present invention relates to hydraulic actuators in internal combustion engines, and more particularly, to oil passage structures used to supply oil in, for example, variable valve timing mechanisms of an internal combustion engine.

2. Description of the Related Art

In the prior art, variable valve timing mechanisms have been employed to change the valve timing of intake valves and exhaust valves in response to the operating state of an engine. A variable valve timing mechanism (VVT) that displaces the rotational phase (displacement angle) of the camshaft with respect to a timing pulley using hydraulic pressure is one known type of variable valve timing mechanism.

Japanese Unexamined Patent Application No. 6-330712 describes a typical VVT mechanism. An oil passage extending along the center axis of a camshaft is communicated with a hydraulic pressure chamber provided at the advancing side of the VVT. Another oil passage extending inside the camshaft is communicated with a hydraulic pressure chamber provided at the retarding side of the VVT. The hydraulic pressure chamber at the advancing side and the hydraulic pressure chamber at the retarding side are separated by a hydraulic pressure piston.

When varying the valve timing, the hydraulic pressure piston of the VVT moves in the axial direction of the camshaft in response to differences between the pressure in the hydraulic pressure chamber at the advancing side and the hydraulic pressure chamber at the retarding side. The camshaft rotates relative to the pulley toward the advancing side or the retarding side in accordance with the displacement of the hydraulic pressure piston. This varies the valve timing. The pair of oil passages inside the camshaft is connected to a control valve by a pair of annular grooves extending along the circumferential surface of the camshaft. The hydraulic pressure in the pair of hydraulic pressure chambers is controlled by adjusting the position of a spool valve arranged inside the control valve.

A pressure difference develops between the pair of oil passages inside the camshaft when varying the valve timing. Therefore, oil may leak from the annular grooves along the circumferential surface of the camshaft. This type of oil leakage degrades the control responsiveness of the valve timing mechanism.

The clearance between the camshaft and its bearing can be minimized to prevent leakage of oil. However, this may result in an increase in the sliding resistance between the camshaft and the bearing and hinder smooth rotation of the camshaft. As another way to prevent leakage of oil, the distance between the pair of annular grooves may be increased. However, this increases the axial length of the camshaft at the bearing and enlarges the engine size.

SUMMARY OF THE INVENTION

Accordingly, it is an objective of the present invention to provide a fluid passage structure in an internal combustion engine that prevents fluid leakage from the fluid passage structure and avoids enlargement of the size of the internal combustion engine.

In order to achieve the above objective, the present invention provides a hydraulic actuator. The actuator includes a rotatable shaft having a circumferential surface. An actuation member is connected to the shaft. A first passage and a second passage extends through the shaft. The actuation member is moved in accordance with differences in pressure applied to the actuation member through the passages. A first port is located on the circumferential surface serving as an opening to the first passage. A second port is located on the circumferential surface serving as an opening to the second passage. A bearing rotatably supports the shaft. The bearing has a bearing surface facing the circumferential surface of the shaft. First and second grooves are defined in the bearing surface and arranged at different positions with respect to the axial and circumferential directions of the shaft. The first and second grooves communicate with the first and second passages through the first and second ports, respectively. The first and second grooves are substantially sealed by portions of the circumferential surface of the shaft to form hydraulic passages through which pressurized hydraulic fluid flows while the shaft rotates.

BRIEF DESCRIPTION OF THE DRAWINGS

The features of the present invention that are believed to be novel as set forth with particularity in the appended claims. The invention, together with objects and advantages thereof, may be best understood by reference to the following description of the presently preferred embodiments together with the accompanying drawings in which:

DETAILED DESCRIPTION OF THE PREFERRED EMBODIMENTS

A first embodiment of an oil passage structure of an internal combustion engine according to the present invention will now be described with reference to the drawings.

Figure 8:
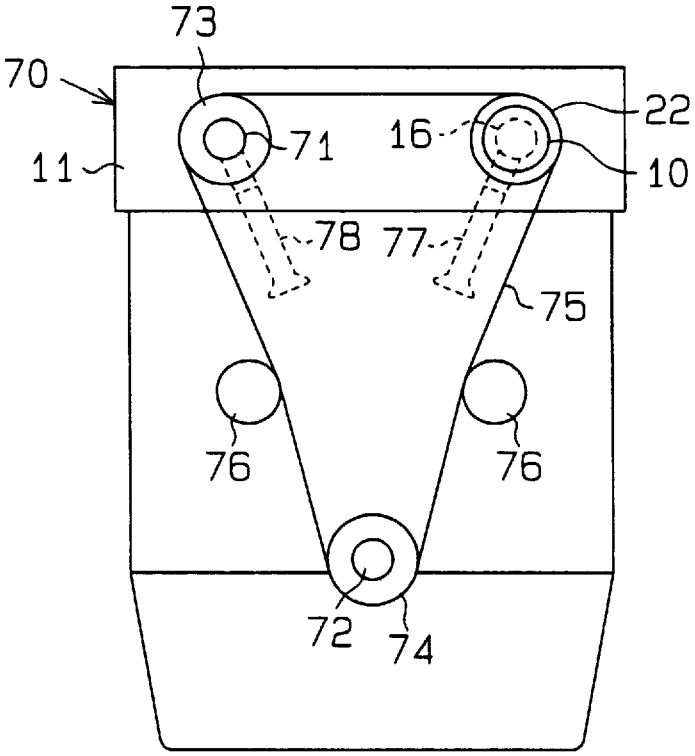
FIG. 8 is a schematic front view of the engine.

As shown in FIG. 8, an internal combustion engine 70 is provided with an intake side camshaft 16, an exhaust side camshaft 71, and a crankshaft 72. The shafts 16, 71, 72 are connected to one another by pulleys 22, 73, 74 and a timing belt 75. Two idlers 76 apply tension to the belt 75. The VVT 10 of this embodiment is provided on the intake camshaft 16. The belt 75 and the pulleys 22, 73, 74 rotate the camshafts 16, 71 in synchronism with the crankshaft 72. Thus, the rotation of the crankshaft 72 drives intake valves 77 and exhaust valves 78 with a predetermined valve timing.

Figure 4:
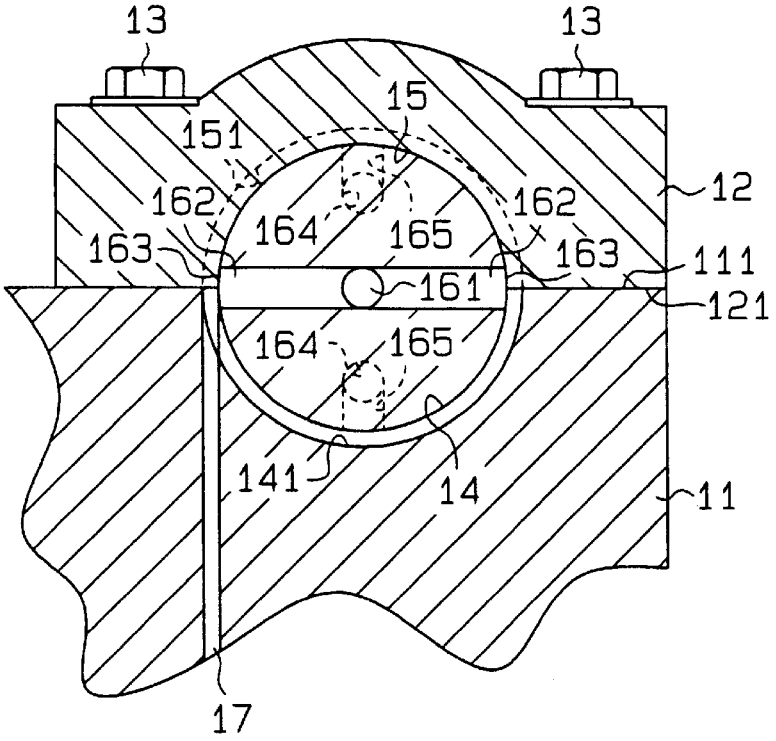
FIG. 4 is an enlarged cross-sectional view taken along line 4—4 in FIG. 1.

As shown in FIG. 4, a pair of bolts 13 fasten and fix a cam cap 12, which functions as a second bearing, to a cylinder head 11, which functions as a first bearing. Engaging surfaces 111, 121 and bearing surfaces 14, 15, which are semi-cylindrical surfaces, are defined on the cylinder head 11 and opposing cam cap 12, respectively. The cylinder head 11 and the cam cap 12 are joined to each other at the engaging surfaces 111, 121. The camshaft 16 is rotatably supported by the bearing surfaces 14, 15.

Figure 2:
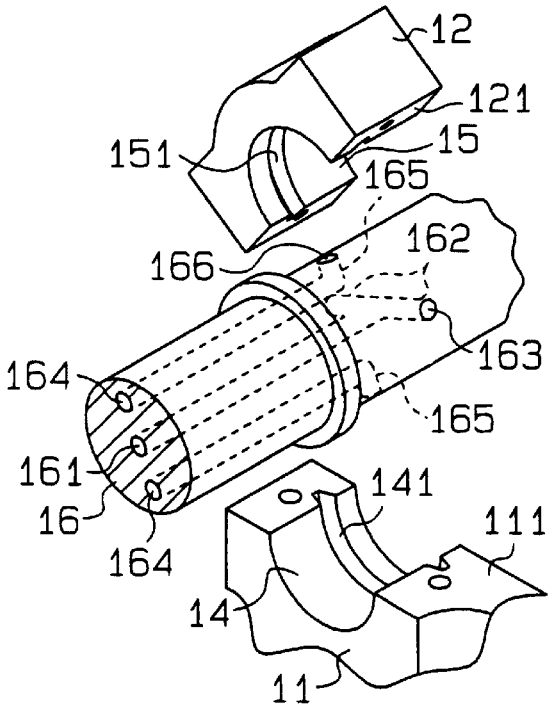
FIG. 2 is an exploded perspective view showing part of the oil passage structure of FIG. 1.
Figure 3:
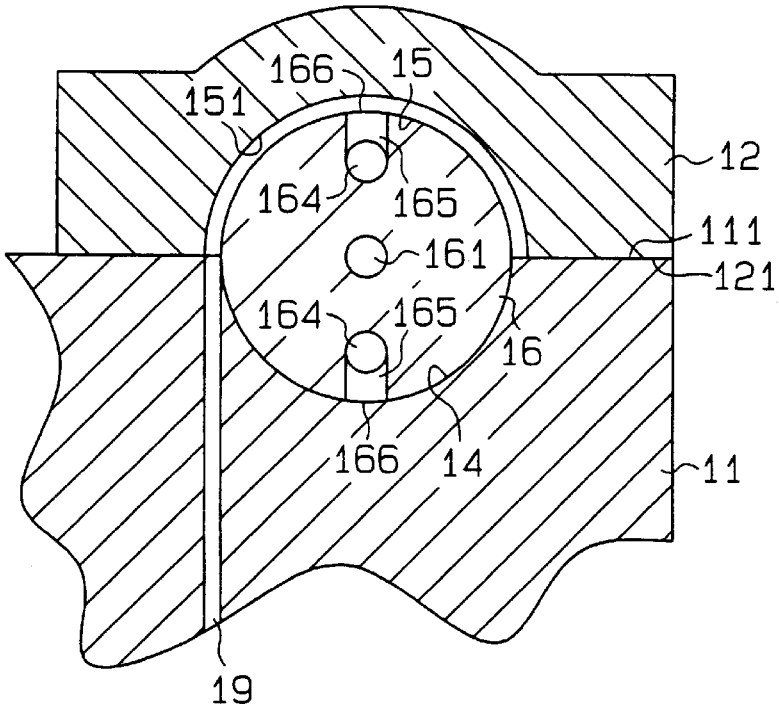
FIG. 3 is an enlarged cross-sectional view taken along line 3—3 in FIG. 1.

As shown in FIGS. 2 and 4, a first oil groove 141 extends along the entire semi-cylindrical bearing surface 14 of the cylinder head 11. As shown in FIG. 3, a second oil groove 151 extends along the entire semi-cylindrical bearing surface 15 of the cam cap 12. The first oil groove 141 and the second oil groove 151 are offset from each other in the axial direction of the camshaft 16. Further, the first and second oil grooves 141, 151 are opened at the associated engaging surfaces 111, 121.

Figure 1:
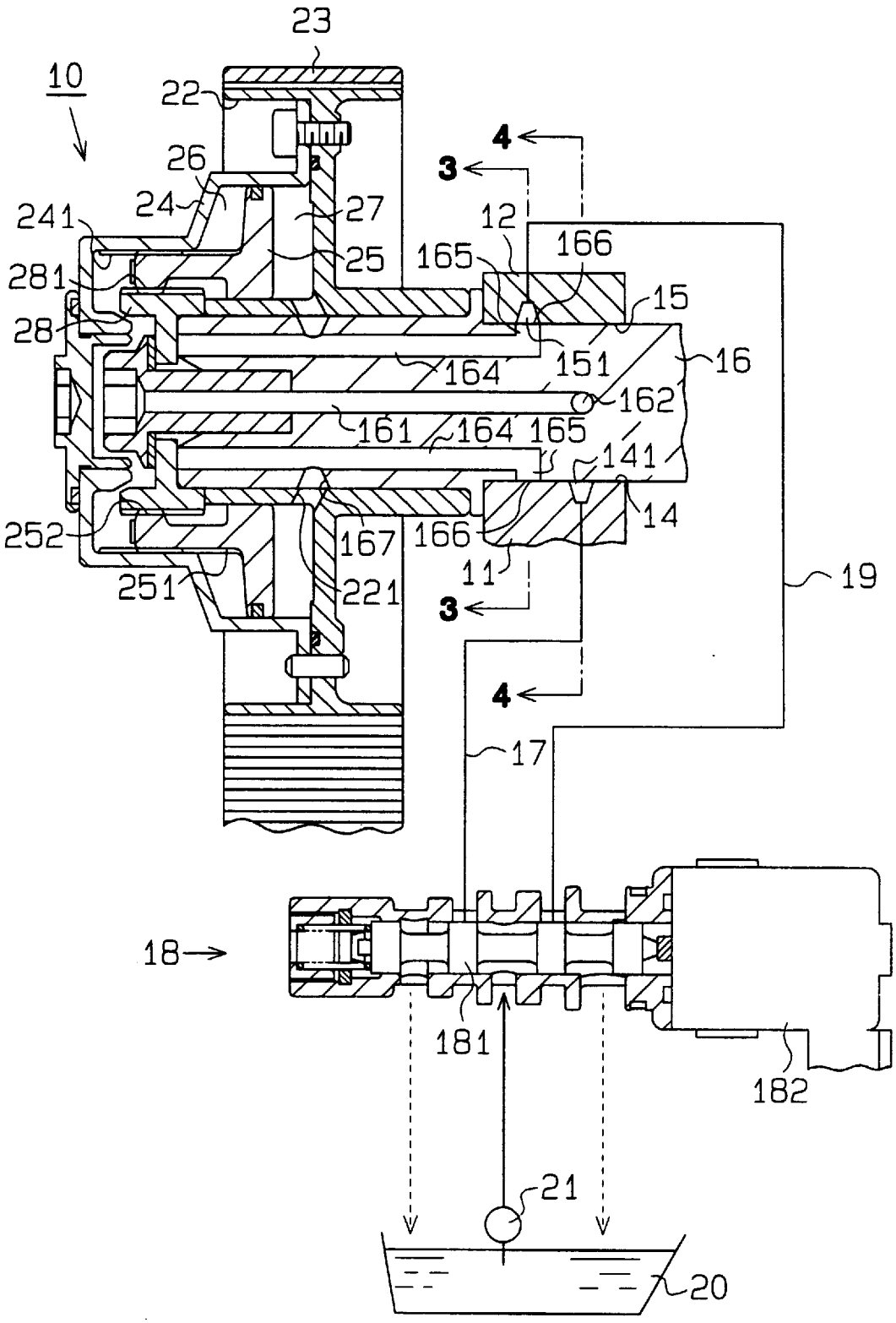
FIG. 1 is a cross-sectional view showing an oil passage structure of a first embodiment according to the present invention.

As shown in FIGS. 1 and 2, a first oil passage 161 extends along the center axis of the camshaft 16. A plurality of passages 162 (two in this embodiment) extend radially from the inner end of the oil passage 161 with equal angular intervals between one another and are opened at the circumferential surface of the camshaft 16. The opening of the passages 162 serve as first ports 163. The rotation locus of the first ports 163 corresponds to the first oil groove 141. During the rotation of the camshaft 16, the pair of first ports 163 are alternately communicated with the oil groove 141. Thus, at least one first port 163 is constantly communicated with the oil groove 141.

A pair of second oil passages 164 extend parallel to the first oil passage 161. The second oil passages 164 mirror one another. Communicating conduits 165 extend radially from the inner ends of the second oil passages 164 in opposite directions and open at the circumferential surface of the camshaft 16. The opening of the communicating conduits 165 serve as second ports 166. The rotation locus of the second ports 166 corresponds to the second oil groove 151. The second ports 166 are positioned at angular intervals of 90 degrees with respect to the first ports 163. During the rotation of the camshaft 16, the pair of second ports 166 are alternately communicated with the second oil groove 151. Thus, at least one second port 166 is constantly communicated with the oil groove 151.

As shown in FIGS. 1 and 4, the first oil groove 141 is connected to a hydraulic pressure control valve 18 through an oil passage 17. As shown in FIG. 1 and FIG. 3, the oil groove 151 is connected to the hydraulic pressure control valve 18 through an oil passage 19. The oil contained in an oil pan 20 is sent to the first oil groove 141 or the second oil groove 151 by an oil pump 21. The location of where the oil is supplied is switched between the first oil groove 141 and the second oil groove 151 by changing the position of a spool valve 181 arranged in the hydraulic pressure control valve 18. The position of the spool valve 181 is controlled by actuating and de-actuating a solenoid 182.

When oil is supplied to the first oil groove 141 through the hydraulic pressure control valve 18, the oil inside the second oil groove 151 is returned to the oil pan through the hydraulic pressure control valve 18. When oil is supplied to the second oil groove 151 through the hydraulic pressure control valve 18, the oil inside the first oil groove 141 is returned to the oil pan 20 through the hydraulic pressure control valve 18.

As shown in FIG. 1, a pulley 22 is fixed to the distal end of the camshaft 16, and a timing belt 23 is wound around the pulley 22. An outer cap 24 is fixed to the pulley 22 and a piston 25 is held between the outer cap 24 and the camshaft 16. The piston 25 is supported so that it can slide in the axial direction of the camshaft 16. The piston 25 partitions the inside of the outer cap 24 into a first hydraulic pressure chamber 26 and a second hydraulic pressure chamber 27. An outer helical spline 251 is provided on the outer surface of a small diameter portion of the piston 25. An inner helical spline 252 is provided on the inner surface of the small diameter portion of the piston 25. Another inner helical spline 241 is provided on the inner surface of the outer cap 24. The outer helical spline 251 meshes with the inner helical spline 241.

An inner cap 28 is fixed to the distal end of the camshaft 16. An outer helical spline 281 is provided on the outer surface of the inner cap 28. The outer helical spline 281 meshes with the inner helical spline 252.

The timing belt 23 transmits the engine power to the pulley 22. The power transmitted to the pulley 22 is transmitted to the piston 25 through the engagement between the inner helical spline 241 and the outer helical spline 251. The power is then transmitted from the piston 25 to the camshaft 16 through the engagement between the inner helical spline 252 and the outer helical spline 281.

The first hydraulic pressure chamber 26 is communicated with the first oil passage 161 through the inner helical spline 241 and the outer helical spline 251. The second hydraulic pressure chamber 27 is connected to the second oil passages 164 through a plurality of openings 221 that extend through a boss of the pulley 22 and an annular communicating groove 167 provided in the camshaft 16.

When oil is supplied to the first oil groove 141 through the hydraulic pressure control valve 18, the pressure of the first hydraulic pressure chamber 26 becomes higher than the pressure of the second hydraulic pressure chamber 27. This pressure difference moves the piston 25 toward the pulley 22. This movement is converted to the rotation of the camshaft 16 by the engagement between the inner helical spline 241 and the outer helical spline 251 and by the engagement between the inner helical spline 252 and the outer helical spline 281. The camshaft 16 rotates in a direction that advances the rotational phase of the camshaft 16 with respect to the pulley 22.

In contrast, when oil is supplied to the second oil groove 151 through the hydraulic pressure control valve 18, the pressure of the second hydraulic pressure chamber 27 becomes higher than the pressure of the first hydraulic pressure chamber 26. This pressure difference moves the piston 25 away from the pulley 22. This movement is converted to the rotation of the camshaft 16 by the engagement between the inner helical spline 241 and the outer helical spline 251 and the engagement between the inner helical spline 252 and the outer helical spline 281. The camshaft 16 rotates in a direction that retards the rotational phase of the camshaft 16 with respect to the pulley 22.

The following advantageous effects are obtained with the first embodiment.

The first and second oil grooves 141, 151 are arranged at different axial positions. That is, the first oil groove 141 and the second oil groove 151 lie in different planes, are offset with respect to each other in the axial direction of the camshaft 16, and do not directly face one another. The portions of the oil grooves 141, 151 that are closest to one another, that is, the ends of the oil grooves 141, 151, are spaced from each other by a distance that corresponds to the axial distance between the oil grooves 141, 151.

In contrast, the pair of annular grooves provided in the prior art oil passage structure lie in the same plane. That is, they face one another. Therefore, in comparison with the prior art structure, the oil passage structure of this embodiment positively prevents oil leakage from the two oil grooves.

The first port 163 of the first oil passage 161 and the second port 166 of the second oil passage 164 are arranged at different peripheral positions on the circumferential surface of the camshaft 16. Therefore, the first port 163 and the second port 166 are not aligned in the axial direction of the camshaft 16. When the camshaft 16 is rotating, there are moments when the ports 163, 166 are adjacent to the engaging surface. Leakage of hydraulic fluid from one groove to another is most likely to occur at 1t these moments. However, since these moments are brief, leakage is minimized. That is, the time during which there is alignment in the axial direction between a port and both grooves (141, 151) is minimized.

The first oil groove 141 and the second oil groove 151 are provided separately in the cylinder head 11 and in the cam cap 12. Since it is not necessary to align two separately formed oil grooves and form a single oil groove, high precision machining is not required. This facilitates the machining of the oil grooves.

The piston 25 is displaced in accordance with the difference between the hydraulic pressure of the first hydraulic pressure chamber 26 and the hydraulic pressure of the second hydraulic pressure chamber 27. The first hydraulic pressure chamber 26 is communicated with the first oil passage 161 and the second hydraulic pressure chamber 27 is communicated with the second oil passage 164. When the pressure of the first hydraulic pressure chamber 26 is higher than the pressure of the second hydraulic pressure chamber 27, the piston 25 is displaced such that the rotational phase of the camshaft 16 is advanced. The application of the present invention is optimal for a valve timing control apparatus, such as that described above, which produces a pressure difference between the first oil passage 161 and the second oil passage 164 to change the rotational phase of the camshaft 16.

When power is transmitted to the camshaft 16 by means of the timing belt 23, the tension of the timing belt 23 produces a load that is applied through the pulley 22 from the cam cap 12 toward the cylinder head 11. This decreases the clearance between the bearing surface 14 and the circumferential surface of the camshaft 16 at the load bearing region. Therefore, oil leakage from between the bearing surface 14 and the camshaft 16 is further restricted.

Normally, the rotational phase of the camshaft 16 is advanced by causing the hydraulic pressure of the first hydraulic pressure chamber 26 to overcome the friction produced between the camshaft 16 and the valves. Therefore, the influence of oil leakage is greater when advancing the rotational phase of the camshaft 16 by supplying oil to the first hydraulic pressure chamber 26 than when retarding the rotational phase of the camshaft 16 by supplying oil to the second hydraulic pressure chamber 27. However, in this embodiment the first oil groove 141 communicated with the first hydraulic pressure chamber 26 is arranged on the bearing surface 14, which more effectively prevents oil leakage. This improves responsiveness when advancing the rotational phase of the camshaft 16.

Figure 5:
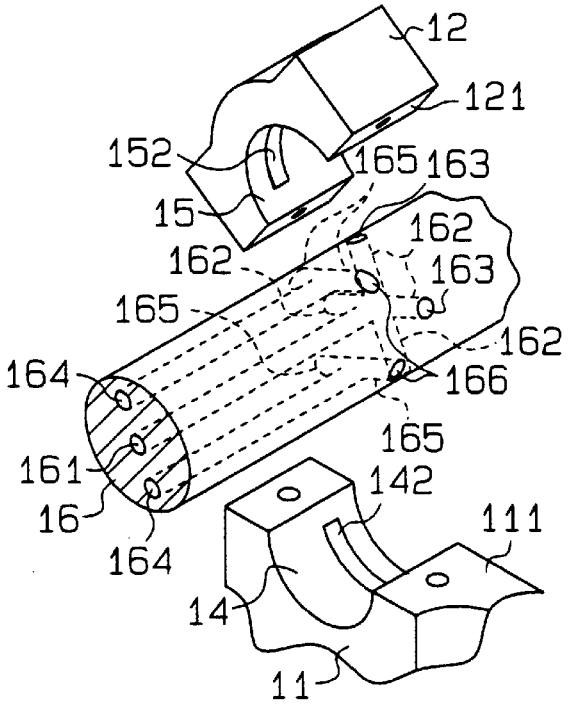
FIG. 5 is an exploded perspective view showing part of an oil passage structure of a second embodiment according to the present invention.

A second embodiment according to the present invention will now be described with reference to FIG. 5. Same reference numerals are given to those components that are like or the same as the corresponding components of the first embodiment.

In this embodiment, the ends of a first oil groove 142 on the bearing surface 14 do not extend to the engaging surface 111 of the cylinder head 11. Furthermore, the ends of a second oil groove 152 on the bearing surface 15 do not extend to the engaging surface 121 of the cam cap 12.

In this embodiment, the number of communicating passages 162 connected to the first oil passage 161 and the number of communicating passages 165 connected to the second oil passage 164 is greater than that of the first embodiment. Four communicating passages 162 are provided with their ports 163 (first ports) arranged at equal angular intervals. Four communicating passages 165 are provided with their ports 166 (second port) arranged at equal angular intervals. Adjacent pairs of the first port 163 and the second port 166 are angularly offset by 45 degrees.

The four first ports 163 are alternately communicated with the first oil groove 142 following the rotation of the camshaft 16. Thus, at least one of the four first ports 163 is constantly communicated with the first oil groove 142. In the same manner, the four second ports 166 are alternately communicated with the second oil groove 152 following the rotation of the camshaft 16. Thus, at least one of the four first ports 166 is constantly communicated with the second oil groove 152.

In the same manner as the first embodiment, the ends of the first oil groove 142 are the closest part of the first oil groove 142 to the second oil groove 152. However, because both oil grooves 142, 152 do not extend to the associated engaging surfaces 111, 121, the distance between the ends of the oil grooves is greater than that of the first embodiment. Accordingly, oil leakage is further restricted.

Figure 6:
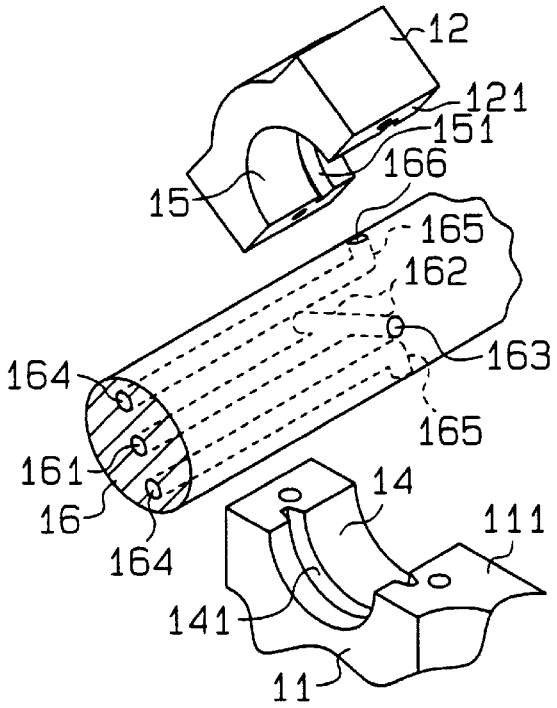
FIG. 6 is an exploded perspective view showing part of an oil passage structure of a third embodiment according to the present invention.

A third embodiment according to the present invention will now be described with reference to FIG. 6. Same reference numerals are given to those components that are like or the same as the corresponding components of the first embodiment. In this embodiment, the ports 166 of the communicating passages 165, which are communicated with the second hydraulic pressure chamber 27, are located at positions further proximal (to the right in FIG. 6) than the ports 163 of the other communicating passage 162, which is communicated with the first hydraulic pressure chamber 26. The position of the first oil groove 141 and the second oil groove 151 are changed accordingly. Thus, the axial locations of the first and second oil grooves 141, 151 in this embodiment are opposite to those of the first and second grooves 141, 151 in the first embodiment. The advantageous effects obtained in the first embodiment are also obtained in this embodiment.

Figure 7:
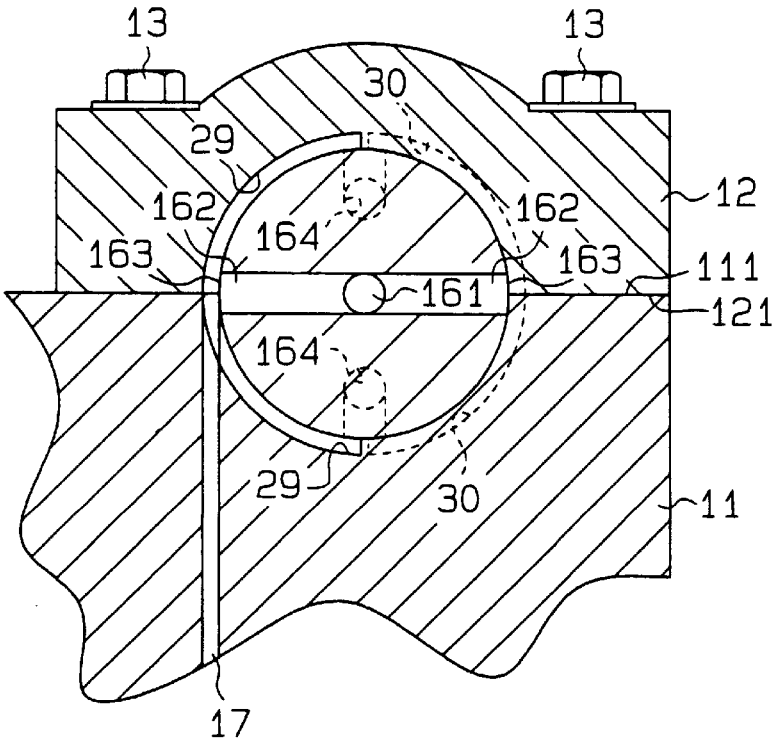
FIG. 7 is an enlarged cross-sectional view of a fourth embodiment according to the present invention.

A fourth embodiment according to the present invention will now be described with reference to FIG. 7. Same reference numerals are given to those components that are like or the same as the corresponding components of the first embodiment. In this embodiment, a first oil groove 29, which is communicated with the first hydraulic pressure chamber 26, and a second oil groove 30, which is communicated with the second hydraulic pressure chamber 27, extend across the bearing surface 14 of the cylinder head 11 and the bearing surface 15 of the cam cap 12. The oil grooves 29, 30 lie in different planes and are axially spaced. That is, they do not directly face one another. Therefore, the advantageous effects obtained in the first embodiment are also obtained in this embodiment.

What is claimed is:

1. A hydraulic actuator comprising:

a rotatable shaft having a circumferential surface;

an actuation member connected to the shaft;

a first passage and a second passage extending through the shaft, wherein said actuation member is moved in accordance with differences in pressure applied to the actuation member through the passages;

a first port located in the circumferential surface serving as an opening to the first passage;

a second port located in the circumferential surface serving as an opening to the second passage;

a bearing for rotatably supporting the shaft, the bearing having a bearing surface facing the circumferential surface of the shaft;

first and second grooves defined in said bearing surface and arranged at different positions with respect to the axial and circumferential directions of said shaft, said first and second grooves communicating with said first and second passages through said first and second ports, respectively;

wherein the first and second grooves are substantially sealed by portions of the circumferential surface of the shaft to form hydraulic passages though which pressurized hydraulic fluid flows while the shaft rotates;

wherein the first groove does not circumferentially overlap the second groove when viewed in the axial direction.

2. The hydraulic actuator as set forth in claim 1, wherein said first port is arranged at a different angular position on the circumferential direction of said shaft from the position of the second port.

3. The hydraulic actuator as set forth in claim 1, wherein said bearing has a first part and a second part, each part having an engaging surface such that the first and second parts are joined to each other at the engaging surface.

4. A hydraulic actuator comprising:

a rotatable shaft having a circumferential surface;

an actuation member connected to the shaft;

a first passage and a second passage extending through the shaft, wherein said actuation member is moved in accordance with differences in pressure applied to the actuation member through the passages;

a first port located in the circumferential surface serving as an opening to the first passage;

a second port located in the circumferential surface serving as an opening to the second passage, a bearing for rotatably supporting the shaft, the bearing having a bearing surface facing the circumferential surface of the shaft, said bearing having a first part and a second part, each part having an engaging surface such that the first and second parts are joined to each other at the engaging surface;

first and second grooves defined in said bearing surface and arranged at different positions with respect to the axial and circumferential directions of said shaft, said first and second grooves communicating with said first and second passages through said first and second ports, respectively, the first and second grooves being substantially sealed by portions of the circumferential surface of the shaft to form hydraulic passages though which pressurized hydraulic fluid flows while the shaft rotates, wherein said first groove is formed in the first part of the bearing, and wherein the second groove is formed in the second part of the bearing.

5. The hydraulic actuator as set forth in claim 4, wherein at least a portion of each of the first and second grooves is arcuate, and each arcuate portion extends circumferentially about the shaft for 180 degrees and opens to the associated engaging surface.

6. The hydraulic actuator as set forth in claim 1, wherein at least a portion of each of the first and second grooves is arcuate, and each arcuate portion extends circumferentially about the shaft for less than 180 degrees.

7. The hydraulic actuator as set forth in claim 3, wherein said first groove and second groove each extend across the bearing surface.

8. The hydraulic actuator as set forth in claim 1 further comprising:

a rotatable drive member rotatably supported by said shaft;

a housing connected to said drive member;

the actuation member being reciprocally accommodated in an interior of said housing such that the actuation member partitions the interior of said housing into a first fluid chamber and a second fluid chamber, wherein movement of said actuation member varies the rotational phase of the shaft with respect to said drive member; and said first and a second fluid chambers being connected to said first and second passages, respectively.

9. A variable valve timing mechanism for varying the timing of valves in an internal combustion engine comprising:

a rotatable drive member driven by the engine;

a rotatable drive shaft for actuating the valves, wherein the valve timing is varied by altering the rotational phase of the shaft with respect to the rotational phase of the drive member, wherein the drive member is supported by the shaft and is rotatable with respect to the shaft;

a housing secured to said drive member;

an actuation member reciprocally accommodated in the interior of said housing such that the actuation member partitions the interior of said housing into a first fluid chamber and a second fluid chamber, wherein movement of said actuation member varies the rotational phase of the shaft with respect to said drive member;

a first passage for supplying fluid to the first fluid chamber and a second passage for supplying fluid to the second fluid chamber to move said actuation member by producing a pressure difference between said first and second fluid chambers;

a first port located on the circumferential surface serving as an opening to the first passage;

second port located on the circumferential surface serving as an opening to the second passage;

a bearing for rotatably supporting the shaft, the bearing having a bearing surface facing the circumferential surface of the shaft;

first and second grooves defined in said bearing surface and arranged at different positions with respect to the axial and circumferential directions of said shaft, said first and second grooves communicating with said first and second passages through said first and second ports, respectively;

wherein the first and second grooves are substantially sealed by portions of the circumferential surface of the shaft to form hydraulic passages through which pressurized hydraulic fluid flows while the shaft rotates;

wherein the first groove does not circumferentially overlap the second groove when viewed in the axial direction.

10. The variable valve timing mechanism as set forth in claim 9, wherein said first port is arranged at a different angular position on the circumferential direction of said shaft from the position of the second port.

11. The variable valve timing mechanism as set forth in claim 9, wherein said bearing has a first part and a second part, each part having an engaging surface such that the first and second parts are joined to each other at the engaging surface.

12. A variable valve timing mechanism for varying the timing of valves in an internal combustion engine comprising:

a rotatable drive member driven by the engine;

a rotatable drive shaft for actuating the valves, wherein the valve timing is varied by altering the rotational phase of the shaft with respect to the rotational phase of the drive member, wherein the drive member is supported by the shaft and is rotatable with respect to the shaft;

a housing secured to said drive member;

an actuation member reciprocally accommodated in the interior of said housing such that the actuation member partitions the interior of said housing into a first fluid chamber and a second fluid chamber, wherein movement of said actuation member varies the rotational phase of the shaft with respect to said drive member;

a first passage for supplying fluid to the first fluid chamber and a second passage for supplying fluid to the second fluid chamber to move said actuation member by producing a pressure difference between said first and second fluid chambers;

a first port located on the circumferential surface serving as an opening to the first passage;

a second port located on the circumferential surface serving as an opening to the second passage;

a bearing for rotatably supporting the shaft, the bearing having a bearing surface facing the circumferential surface of the shaft, said bearing having a first part and a second part, each part having an engaging surface such that the first and second parts are joined to each other at the engaging surface;

first and second grooves defined in said bearing surface and arranged at different positions with respect to the axial and circumferential directions of said shaft, said first and second grooves communicating with said first and second passages through said first and second ports, respectively, the first and second grooves being substantially sealed by portions of the circumferential surface of the shaft to form hydraulic passages through which pressurized hydraulic fluid flows while the shaft rotates, wherein said first groove is formed in the first part of the bearing, and the second groove is formed in the second part of the bearing.

13. The variable valve timing mechanism as set forth in claim 12, wherein at least a portion of each of the first and second grooves is arcuate, and each arcuate portion extends circumferentially about the shaft for 180 degrees and opens to the associated engaging surface.

14. The variable valve timing mechanism as set forth in claim 9, wherein at least a portion of each of the first and second grooves is arcuate, and each arcuate portion extends circumferentially about the shaft for less than 180 degrees.

15. The variable valve timing mechanism as set forth in claim 11, wherein said first groove and second groove each extend across the bearing surface.

16. A variable valve timing mechanism for varying the timing of valves in an internal combustion engine comprising:

a rotatable drive member driven by the engine;

a camshaft for actuating the valves, wherein the valve timing is varied by altering the rotational phase of the camshaft with respect to the rotational phase of the drive member, wherein the drive member is supported by the camshaft and is rotatable with respect to the camshaft;

a housing secured to said drive member;

a piston reciprocally accommodated in the interior of said housing such that the piston partitions the interior of said housing into a first fluid chamber and a second fluid chamber, wherein the piston transmits torque from the drive member to the camshaft, and wherein movement of said piston vanes the rotational phase of the camshaft with respect to the rotational position of the drive member such that the phase of the camshaft is advanced with respect to that of the drive member by the piston when pressure in the first fluid chamber is higher than the pressure in the second fluid chamber, and wherein the phase of the camshaft is retarded with respect to the position of the drive member when the pressure in the second fluid chamber is higher than the pressure in the first fluid chamber;

a first passage for supplying fluid to the first fluid chamber and a second passage for supplying fluid to the second fluid chamber to move said piston by producing a pressure difference between said first and second fluid chambers, the first and second passages being formed inside the camshaft;

a first port located on the circumferential surface serving as an opening to the first passage;

a second port serving as an opening to the second passage;

a bearing for rotatably supporting the camshaft, the bearing having a bearing surface facing the circumferential surface of the camshaft;

first and second grooves defined in said bearing surface and arranged at different positions with respect to the axial and circumferential directions of said camshaft, said first and second grooves communicating with said first and second passages through said first and second ports, respectively;

wherein the first and second grooves are substantially sealed by portions of the circumferential surface of the camshaft to form hydraulic passages through which pressurized hydraulic fluid flows while the camshaft rotates;

wherein the first groove does not circumferentially overlap the second groove when viewed in the axial direction.

17. A variable valve timing mechanism for varying the timing of valves in an internal combustion engine comprising:

a rotatable drive member driven by the engine;

a camshaft for actuating the valves, wherein the valve timing is varied by altering the rotational phase of the camshaft with respect to the rotational phase of the drive member, wherein the drive member is supported by the camshaft and is rotatable with respect to the camshaft;

a housing secured to said drive member;

a piston reciprocally accommodated in the interior of said housing such that the piston partitions the interior of said housing into a first fluid chamber and a second fluid chamber, wherein the piston transmits torque from the drive member to the camshaft, and wherein movement of said piston vanes the rotational phase of the camshaft with respect to the rotational position of the drive member such that the phase of the camshaft is advanced with respect to that of the drive member by the piston when pressure in the first fluid chamber is higher then the pressure in the second fluid chamber, and wherein the phase of the camshaft is retarded with respect to the position of the drive member when the pressure in the second fluid chamber is higher than the pressure in the first fluid chamber;

a first passage for supplying fluid to the first fluid chamber and a second passage for supplying fluid to the second fluid chamber to move said piston by producing a pressure difference between said first and second fluid chambers, the first and second passages being formed inside the camshaft;

a first port located on the circumferential surface serving as an opening to the first passage;

a second port serving as an opening to the second passage;

a bearing for rotatably supporting the camshaft, the bearing having a bearing surface facing the circumferential surface of the camshaft;

first and second grooves defined in said bearing surface and arranged at different positions with respect to the axial and circumferential directions of said camshaft, said first and second grooves communicating with said first and second passages through said first and second ports, respectively;

wherein the first and second grooves are substantially sealed by portions of the circumferential surface of the camshaft to form hydraulic passages through which pressurized hydraulic fluid flows while the camshaft rotates, wherein said bearing has a first part and a second part, each part having an engaging surface such that the first and second parts are joined to each other at the engaging surface, said first groove is formed in the first part, the second groove is formed in the second part, and said drive member is a pulley driven by a timing belt, said timing belt being arranged to apply a load to said camshaft directed toward said first part.

* * * * *